US005255781A

United States Patent [19]

Dulyea, Sr.

[11] Patent Number: 5,255,781

[45] Date of Patent: Oct. 26, 1993

[54] CLUB ORGANIZER FOR GOLF BAGS

[76] Inventor: Kenneth W. Dulyea, Sr., 5159 Brookside Ct., Whitehall, Mich. 49461

[21] Appl. No.: 909,291

[22] Filed: Jul. 6, 1992

[51] Int. Cl.[5] ..... A63B 55/04

[52] U.S. Cl. ..... 206/315.6; 206/315.3; 190/110; 211/70.2

[58] Field of Search ..... 206/315.3, 315.6, 315.8; 190/109, 110, 111; 248/96; 211/70.2

[56] References Cited

U.S. PATENT DOCUMENTS

| | | | |
|---|---|---|---|
| 1,227,657 | 5/1917 | Pierce . | |
| 2,128,546 | 8/1938 | Venmore | 206/315.6 |
| 2,521,573 | 9/1950 | Filler et al. | 206/315.3 |
| 2,546,416 | 12/1951 | Alter et al. . | |
| 2,549,055 | 4/1951 | Burton, Jr. . | |
| 2,568,810 | 9/1951 | Kish, Jr. . | |
| 2,705,518 | 5/1955 | Burton, Jr. . | |
| 2,926,713 | 3/1960 | Vaughhan | 211/70.2 |
| 3,503,518 | 3/1970 | Black | 211/70.2 |
| 3,980,115 | 9/1976 | Longo . | |
| 4,111,248 | 9/1978 | Leichhardt | 206/315.6 |
| 4,172,484 | 10/1979 | Henning . | |
| 4,311,178 | 1/1982 | Kennedy . | |
| 4,420,024 | 12/1983 | Clayton | 206/315.6 |
| 4,509,643 | 4/1985 | Rhee | 206/315.6 |
| 4,522,299 | 6/1985 | Clark et al. . | |
| 4,691,823 | 9/1987 | Pape . | |
| 4,753,344 | 6/1988 | Antonious . | |
| 4,768,650 | 9/1988 | Chancellor, Jr. . | |
| 5,029,703 | 7/1991 | Dulyea, Sr. . | |
| 5,060,796 | 10/1991 | Brooks, III . | |

*Primary Examiner*—David T. Fidei

*Attorney, Agent, or Firm*—Dennison, Meserole, Pollack & Scheiner

[57] ABSTRACT

An organizer for golf clubs comprising a sheet of substantially rigid material formed with a series of alternating full length corrugations. The sheet is rolled into a cylinder with the corrugations forming inner and outer compartments. The organizer is received within a cylindrical golf bag with the outer compartments closed by the surrounding bag and the inner compartments partially closed by removable cross members. A retaining rack overlying the organizer provides a club gripping retainer associated with each compartment.

12 Claims, 2 Drawing Sheets

FIG. 5
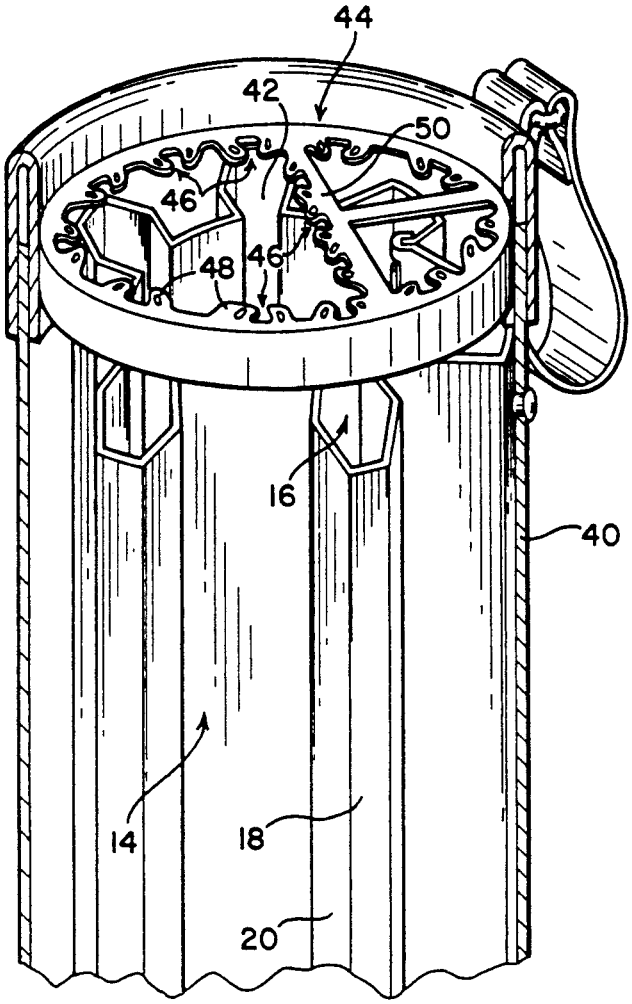
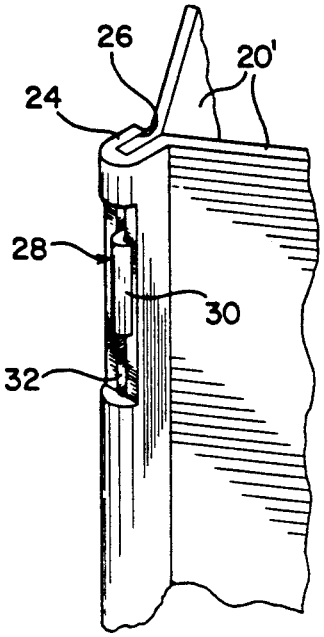
FIG. 4
FIG. 6
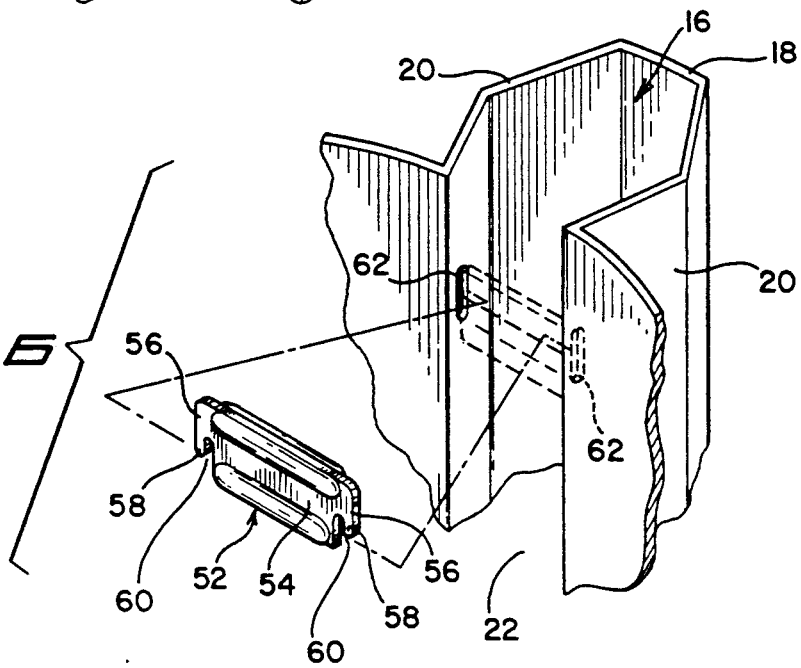

CLUB ORGANIZER FOR GOLF BAGS

BACKGROUND OF THE INVENTION

Golf clubs are conventionally carried in open topped bags which receive the club shafts with the club heads upwardly directed for ready identification and access thereto.

In order to prevent excess movement of the clubs within the bag, which gives rise to possible club damage, the bag is frequently provided with means for separating the individual clubs. For example, attention is directed to applicant's prior Pat. No. 5,029,703, issued Jul. 9, 1991, to Dulyea, Sr.

The known club organizers or separators take many forms, including those which separate the clubs solely at the head end thereof, and those which provide separate shaft-receiving chambers for the full height of the bag. Known organizers which provide for full height or substantially full height separation can be of relatively rigid construction as shown in Burton, U.S. Pat. No. 2,705,518, or more flexible material as in Pierce, U.S. Pat. No. 1,227,657.

SUMMARY OF THE INVENTION

The club organizer of the present invention is particularly adapted for engagement within cylindrical golf bags, that is golf bags of circular cross section. The organizer is formed from a single corrugated sheet of synthetic resinous material rolled into a generally cylindrical configuration and edge secured to define an elongate rigid tubular member received within a golf bag either as a separate insert or as the major structural component thereof.

The object of the organizer is to provide full length compartments or chambers peripherally about the interior of the bag for receiving, in each instance, a single club shaft segregated from the remaining club shafts to avoid undesirable and possible damaging contact therebetween.

The organizer is particularly adapted for use with an overlying retainer, of the type shown in Dulyea, U.S. Pat. No. 5,029,703, with each club, adjacent the head thereof, having the shaft releasably clamped within a retainer. Alternately, the organizer itself can incorporate releasable retainers which prevent lateral movement of the clubs from at least selected of the compartments.

The compartments comprise, relative to the bag which receives the organizer, alternating inwardly and outwardly directed compartments which are defined by full length corrugations in the sheet which forms the organizer.

While the outer corrugation formed compartments are longitudinally closed by engagement thereof against the side of the bag, the corrugation formed inwardly directed compartments open into the central area of the bag. The transverse opening of the inner compartments toward the central area of the bag is slightly constricted by the forming of the inner compartments with converging side wall portions which in themselves will tend to retain the club shafts within the corresponding compartments.

However, it is preferred that a more effective retention of the clubs be effected. As such, the organizer of the invention will normally be used in conjunction with an overlying rack encircling the interior of the bag immediately above the organizer. The rack is provided with an inwardly directed retainer associated with each of the compartments and adapted to snap engage with the shaft of a compartment received club, thus not only retaining the club within the compartment but also preventing excess movement of the club within the compartment. The rack can also include a cross bar spanning the interior area of the bag for retention of clubs within this internal area.

As an alternative to use of the rack, the inwardly opening compartments can, adjacent the upper end of the organizer, be provided with a pair of opposed slots which releasably receive the opposed ends of a cross member spanning the open side of the compartment to prevent movement of a received club therethrough.

BRIEF DESCRIPTION OF THE DRAWINGS

FIG. 4 is a perspective detail illustrating the manner in which the longitudinal edges of the sheet are interlocked to form the cylindrical organizer;

FIG. 5 is a top perspective view illustrating a retaining rack utilized in conjunction with the organizer; and FIG. 6 is a perspective detail illustrating a removable cross member utilized to selectively close the inwardly opening compartments.

DESCRIPTION OF PREFERRED EMBODIMENTS

Figure 1:
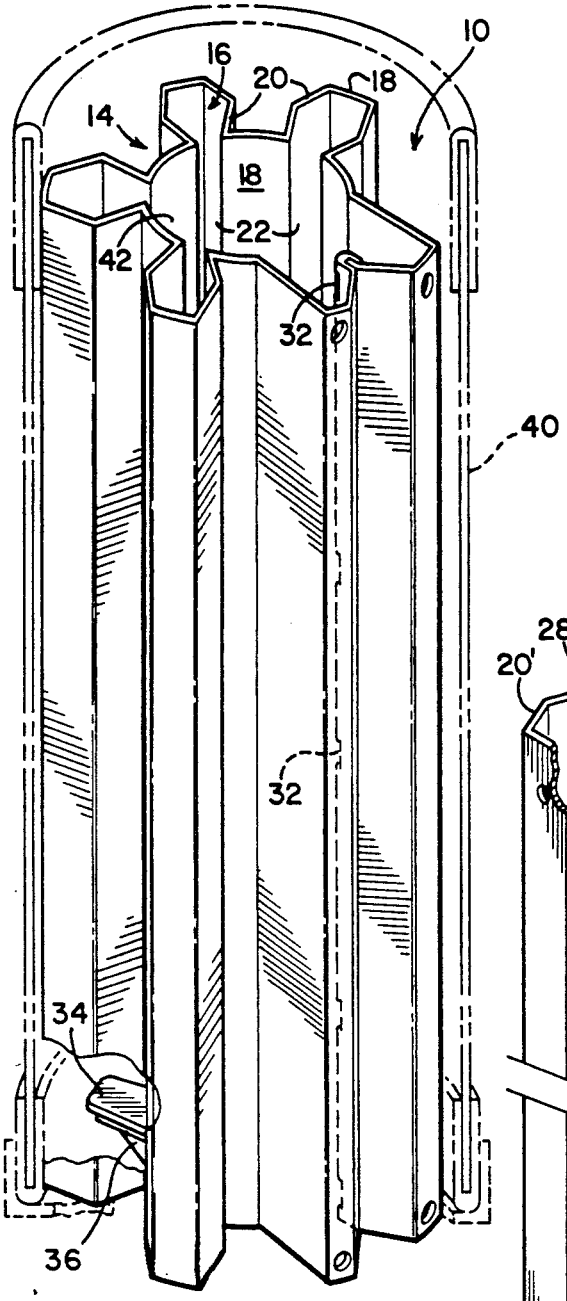
FIG. 1 is a perspective view of the organizer illustrating its relationship to a surrounding golf bag.

Referring now more specifically to the drawings, the club organizer 10 is formed from a single sheet 12 of substantially rigid synthetic resinous material capable of being rolled into a self sustaining tubular configuration. The sheet 12 has full length oppositely alternating corrugations therein defining a series of longitudinal alternating outer and inner compartments 14 and 16 respectively. Each compartment includes a full length flat rear wall 18 and opposed side walls 20 which, in the inner compartments 16, initially diverge forwardly from the rear wall 18 and terminate in converging forward side wall portions which define a full length forward or inwardly directed opening 22 of a transverse width substantially less than that of the inner compartment 16 at the transverse center thereof. The outer compartments 14 are in turn formed with substantially wider outerwardly directed open mouths.

The opposed longitudinal edge portions of the sheet 12 each comprise a side wall 20' of an edgemost inwardly directed compartment 16'. One of these edge walls 20, includes a reversely turned flange 24 which, with the adjacent wall portion, defines a narrow slot 26. This slot 26, upon a rolling or folding of the sheet 12 into a cylinder, frictionally receives the corresponding portion of the opposite outer wall 20'. This opposite outer wall includes a series of vertically elongate projecting locking tabs 28 at spaced points along the outer edge thereof. Each of these tabs 28 includes a laterally enlarged locking head 30 thereon. The tabs 28 project through corresponding slightly elongate apertures 32 through the base or bight portion of the slot 26 to effect a locking of the sheet in the final cylindrical configuration thereof.

Figure 2:
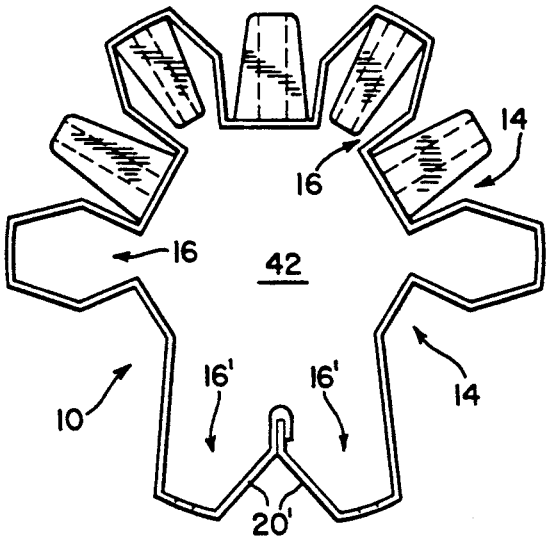
FIG. 2 is a top plan view of the organizer prior to insertion into a golf bag.
Figure 3:
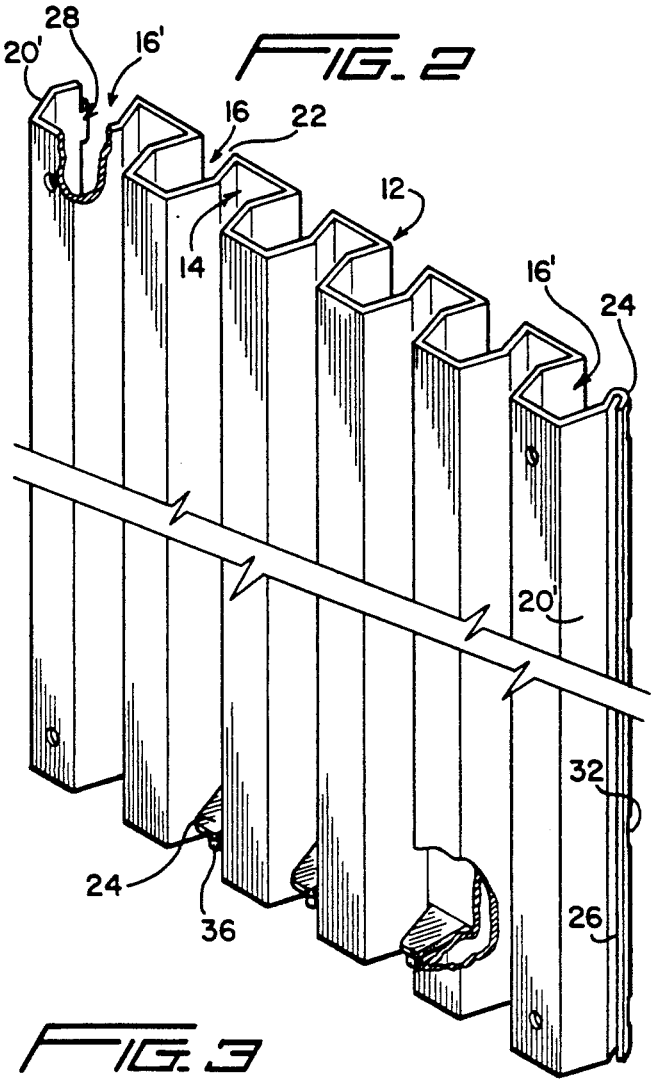
FIG. 3 is a perspective view of the corrugated sheet from which the organizer is formed.

When locked together in the above manner, it will be recognized, as illustrated in FIGS. 1 and 2, that the organizer 10 will actually include two substantially adjacent inner compartments adjacent the interlocked edges, the minor outwardly directed compartment therebetween defined by the interlocked edges 20' themselves being, as a practical matter, too small to effectively accommodate a club shaft. Other than for these two adjacent compartments, the inner and outer compartments alternate about the full peripheral extent of the organizer. The slight "out of round" shape of the organizer 10 in FIG. 2 is the initial shape formed by rolling the sheet 12 and interlocking the edges as above. A more perfect cylindrical shape is achieved upon insertion of the organizer in a cylindrical bag 40.

As it is normally desirable to position the club heads at approximately the same level for easy access thereto, and in order to accommodate the shorter higher number irons, wedges, and the like, five adjacent outer and inner compartments 14, 16 include, upwardly spaced from the lower end of the organizer 10, inwardly projecting platforms 34 integrally formed with the corresponding base walls 18. These platforms 34, in addition to including a planar upper face to receive and seat the outer end of a club handle, will include an underlying angle brace 36 as a strengthening means for enabling accommodation of repeated relatively sharp contact of an introduced club against the platform 34.

In order to properly identify the "shorter" compartments, the five compartments diametrically across from the joined edge walls 20' are provided with the platforms 34. As a further identification and alignment means, it is contemplated that the organizer be mounted within the golf bag 40 itself with the joined outer edges 20' aligned with the golf bag handle.

As described, the typical organizer will include eleven compartments, each of a size as to readily and freely receive a club shaft. As will be noted from, for example, FIG. 1, the outer compartments 14 have the open mouths thereof engaged against the surrounding bag 40, providing in effect closed compartments within which the club shafts cannot be laterally moved. The inner compartments 16, both because of the converging portions of the side walls 20 thereof and the slight contraction of the inner compartment mouths 22 as a result of the rolling of the sheet 12 into cylindrical configuration, provide for restricted lateral access from these inner compartments 16 to the free central area 42 within the organizer 10.

The invention, in addition to providing for a segregation of the individual clubs, also proposes that the individual clubs be secured against movement within the separate compartments. Pursuant thereto, the bag received organizer 10 is overlaid with a retaining rack 44 which surrounds the outer periphery of the upper end of the organizer 10. The rack includes an inwardly projecting retainer 46 overlying the outer side of each of the compartments 14, 16 with each retainer comprising a pair of opposed resilient gripping fingers 48 adapted to snap engage with a club shaft introduced laterally therebetween. Each retainer 46 will securely retain the club shaft until the club shaft is manually forced therefrom. Thus, each club will be both positively fixed in position adjacent the exposed head portion thereof, and completely segregated from adjacent clubs throughout the full height of the club shafts. The relatively large cross sectional area of each compartment, as compared to that of a club shaft, provides ample room for accommodating the corresponding inwardly projecting retainer 46 without interference with the free movement of the club shaft into and out of the compartment.

The illustrated rack 44 generally corresponds to the rack illustrated in Dulyea, U.S. Pat. No. 5,029,703. As with the patented rack, the rack 46 can also include a cross bar 50 spanning a portion of the inner area 42 and similarly mounting several retainers 46 to accommodate such additional clubs as the user may wish to retain within this internal central area.

Both the organizer 10 and the rack 44 can be mounted within the golf bag 40 by appropriate screws or rivets engaged through the bag wall, thereby fixing the positions of the organizer and rack. In light of the rigid nature of the cylindrical organizer 10, the organizer can in fact constitute the major structural component of the bag which, in itself need contain no additional rigidifying components. In such case, the bag 40 will function solely as a means for protectively enclosing the organizer received clubs, providing means for accommodating the bag handle and providing for the carrying of various accessories such as balls, tees, and the like in exterior pockets.

Should it be desirable to selectively restrict lateral movement of the clubs from the inner pockets 16, without reliance on the retainers 46, it is contemplated that each of the inner compartments 16, across the mouth 22 thereof immediately adjacent the upper end, be provided with a removable cross member 52. Each cross member 52 will consist basically of a flat panel 54 of a width sufficient to span the mouth 22 and opposed edge locking flanges 56, each with a downwardly directed lug 58 defining a downwardly directed locking notch 60 between the lug and adjacent edge of the central panel 54 The opposed flanges are received within opposed vertical slots 62 of the opposed side walls 20 of the inner compartment 16. The slots 62 are of a vertical length sufficient so as to receive the entire flange 56 with the cross member 52 shifted vertically downward, after insertion of the flanges 56 through the slot 62, to interlock the adjoining wall portions within the locking notches 60. As desired, the central panel 54 of each cross member 52 can be rigidified by integral enlargements or ribs formed longitudinally thereon.

Removal of the cross members 52 can be easily effected by a grasping of the cross member, an upward shifting of the cross member to disengage the flange notches 60, and a slight lateral flexing of the opposed walls 20 of the corresponding inner compartment 16 to free the flanges 56 from the wall slots 62.

With the cross members 52 spanning the upper portion of the open mouth 22 of each inner compartment 16, it will be appreciated that any possibility of the clubs in these compartments slipping into the open central area 42 is avoided As such, the segregation of the clubs can be maintained whether or not the clubs are individually secured within the retainers 46. Thus, the organizer can be used as an effective means for accommodating the clubs even in the absence of the rack 44. Further, assuming both the presence of the rack 44 and use of the cross members 52, the clubs can be freely received within the compartments during the playing of the game for ready and unencumbered access thereto, with the locking of the individual clubs within the corresponding retainers being effected at other times, for example during the storage and transport of the clubs.

The foregoing is considered illustrative of the principles of the invention, and variations thereof as may occur to those skilled in the art are to be considered within the scope of the invention. As an example, while the organizer has been illustrated with eleven compartments as the preferred embodiment, provision can be made for a greater or lesser number of compartments.

I claim:

1. For use within a golf bag, a club organizer for receiving and positioning golf clubs relative to each other, said club organizer including a vertically elongate sheet of material folded into a vertically elongate generally cylindrical configuration and defining a central area, said sheet having opposed vertical edges with means thereon for interlocking said edges in said cylindrical configuration, said organizer having alternating inner and outer compartments around said central area therein and along the full vertical extent thereof, at least selected ones of said inner compartments including opposed side walls converging inwardly toward said central area and defining a mouth opening inwardly from the corresponding compartment to said central area along the full height of said organizer, said mouth of said at least selected ones of said inner compartments having a transverse width less than that of said opposed side walls for restricting access from said central area to said at least selected ones of said inner compartments.

2. The club organizer of claim 1 wherein said organizer includes an open upper end for introduction and removal of golf clubs, and a lower end, selected ones of said compartments including means therein for defining a seat limiting inward insertion of a golf club, said means for defining seat limiting in each of the corresponding compartments being in vertically spaced relation upward from said lower end of said organizer.

3. The club organizer of claim 2 including retaining means vertically aligned with each compartment adjacent the upper end of said organizer for engaging and retaining a compartment-received golf club.

4. The club organizer of claim 3 including a cross member engageable between said side walls of each inner compartment adjacent the mouth thereof for selectively precluding movement of a compartment-received club through said mouth.

5. The club organizer of claim 4 wherein each said cross member includes opposed edges with locking projections extending therefrom, said corresponding opposed side walls including vertically elongate apertures therein receiving said locking projections upon vertical movement of said cross member relative to said side walls.

6. The club organizer of claim 2 including a cross member engageable between said side walls of each inner compartment adjacent the mouth thereof for selectively precluding movement of a compartment-received club through said mouth.

7. The club organizer of claim 6 wherein each said cross member includes opposed edges with locking projections extending therefrom, said corresponding opposed side walls including vertically elongate apertures therein receiving said locking projections upon vertical movement of said cross member relative to said side walls.

8. For use within a golf bag, a club organizer for receiving and positioning golf clubs relative to each other, said club organizer including a vertically elongate sheet of material folded into a vertically elongate generally cylindrical configuration and defining a central area, said sheet having opposed vertical edges with means thereon for interlocking said edges in said cylindrical configuration, said organizer having alternating inner and outer compartments around said central area therein and along the full vertical extent thereof and wherein at least selected ones of said inner compartments including opposed side walls converging inwardly toward said central area and defining a mouth opening inwardly from the corresponding compartment to said central area along the full height of said organizer, said mouth of said at least selected ones of said inner compartments having a transverse width less than that of said opposed side walls for restricting access from said central area to said at least selected ones of said inner compartments, said organizer further including an open upper end for introduction and removal of clubs, and a lower end, said selected ones of said compartments including means therein for defining a seat limiting inward insertion of a golf club, said means for defining a seat limiting inward insertion in each of the corresponding compartments being in vertically spaced relation upward from said lower end of said organizer.

9. The club organizer of claim 8 including retaining means vertically aligned with each compartment adjacent the upper end of said organizer for engaging and retaining a compartment-received golf club.

10. The club organizer of claim 8 including a cross member engageable between said side walls of each inner compartment adjacent the mouth thereof for selectively precluding movement of a compartment-received club through said mouth.

11. The club positioning means of claim 8 wherein said interlocking means on said sheet edges includes, along one sheet edge, a full length reversely turned edge flange defining an edge slot, said edge slot having a full length inner end with vertically spaced apertures therein, said second longitudinal edge being received within said vertical slot and including lugs extending therefrom and snap engaged through said apertures.

12. For use within a golf bag, a club organizer for receiving and positioning golf clubs relative to each other, said club organizer including a vertically elongate sheet of material folded into a vertically elongate generally cylindrical configuration and defining a central area, said sheet having opposed vertical edges with means thereon for interlocking said edges in said cylindrical configuration, said organizer having alternating inner and outer compartments around said central area therein and along the full vertical extent thereof, said inner compartments each including opposed side walls converging inwardly toward said inner area and defining a mouth opening inwardly from the corresponding compartment to said central area along the full height of said organizer, said mouth of at least a selected ones of said inner compartments having a transverse width less than that of said opposed side walls for restricting access from said central area to said at least selected ones of said inner compartments, and retaining means vertically aligned with selected compartments adjacent the upper end of said organizer for engaging and retaining a compartment-received golf club.

* * * * *